United States Patent [19]

Luciano et al.

[11] Patent Number: 4,892,511

[45] Date of Patent: Jan. 9, 1990

[54] METHOD AND APPARATUS FOR THE AUTOMATIC MANUFACTURE OF FLAT BOTTOM BAGS

[75] Inventors: Robert A. Luciano; Lawrence W. Luciano, both of Lebanon; Don H. Rowe, Westfield, all of N.J.; Violet M. Hanson, 14 Fairway Dr., Old Bethpage, N.Y. 11804

[73] Assignee: Violet M. Hanson, Old Bethpage, N.Y.

[21] Appl. No.: 687,859

[22] Filed: Dec. 31, 1984

[51] Int. Cl.[4] ..... B31B 33/28

[52] U.S. Cl. ..... 493/194; 493/250

[58] Field of Search ..... 493/194, 244, 245, 250, 493/252, 253, 22, 23

[56] References Cited

U.S. PATENT DOCUMENTS

| | | | |
|---|---|---|---|
| 685,805 | 11/1901 | Ward | 493/244 |
| 813,207 | 2/1906 | Hesser | 493/252 |
| 2,412,501 | 12/1946 | Gardner | 493/244 |
| 3,083,618 | 4/1963 | Vergobbi | 493/252 |
| 3,772,116 | 11/1973 | Schaffron | 156/221 |
| 3,916,770 | 11/1975 | Hanson | 493/189 |
| 3,988,970 | 11/1976 | Hanson et al. | 493/194 |
| 4,230,030 | 10/1980 | Hanson et al. | 493/194 |

FOREIGN PATENT DOCUMENTS

| | | | |
|---|---|---|---|
| 324177 | 8/1920 | Fed. Rep. of Germany | 493/244 |
| 218636 | 1/1925 | United Kingdom | 493/252 |

*Primary Examiner*—Frederick R. Schmidt
*Assistant Examiner*—William E. Terrell
*Attorney, Agent, or Firm*—Bauer & Schaffer

[57] ABSTRACT

A method and apparatus for the automatic manufacture of flat bottom bags from a substantially continuous supply of a sealable material whereby the material is formed as a bag having a reinforced sealed flat bottom formed by an interior bag forming assembly that is cooperable with a relatively movable folder assembly that folds the bottom of the bag and removes it from the bag former assembly after a length of the bag is severed from the remainder of the material.

22 Claims, 6 Drawing Sheets

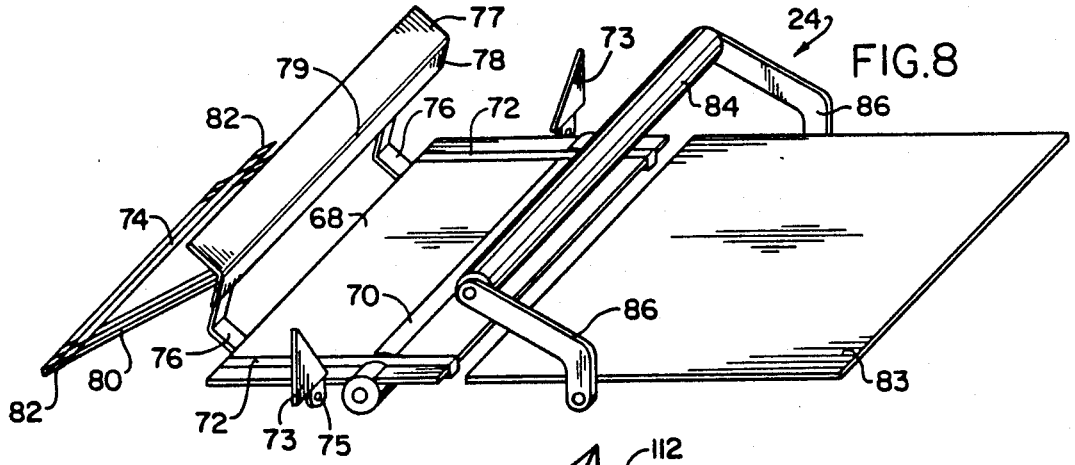
FIG.8
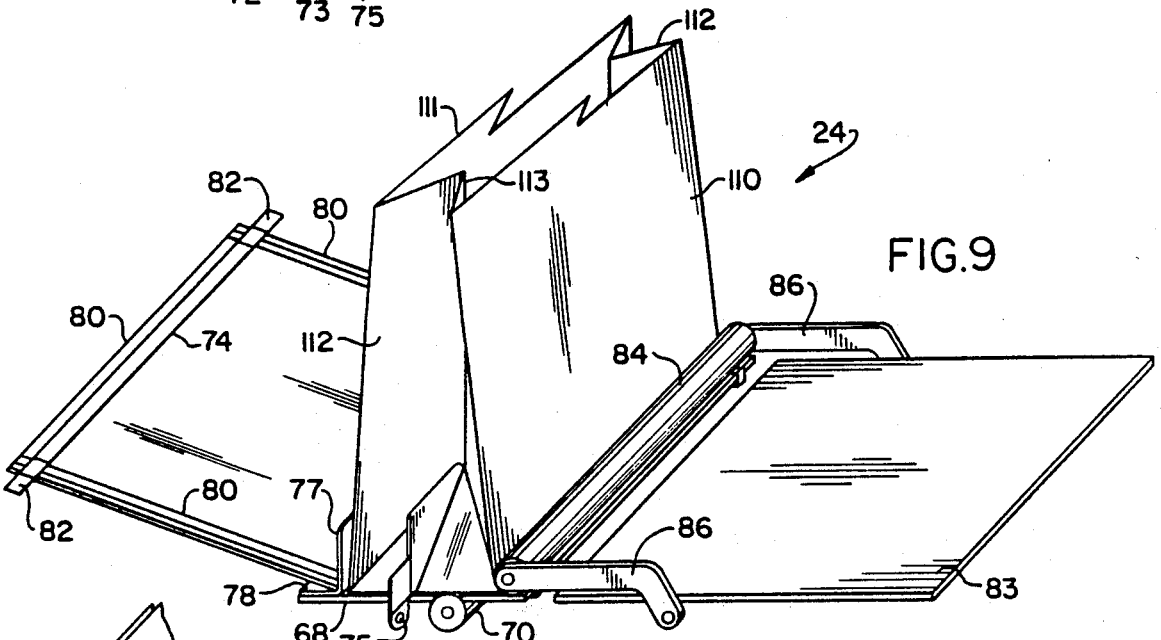
FIG.9
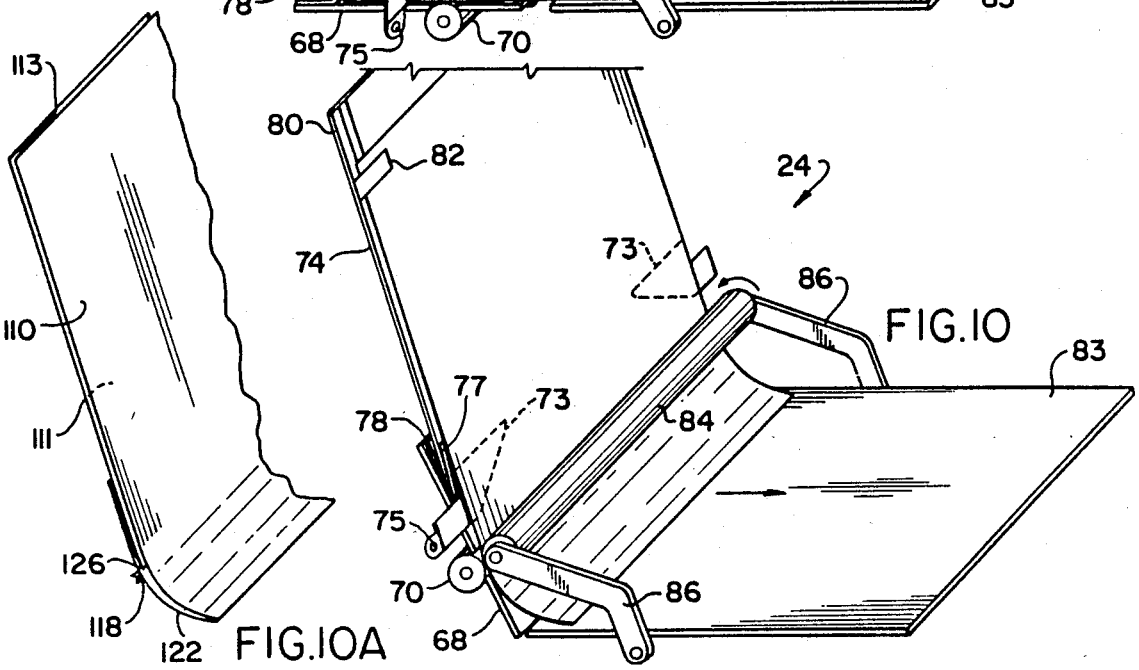
FIG.10
FIG.10A

METHOD AND APPARATUS FOR THE AUTOMATIC MANUFACTURE OF FLAT BOTTOM BAGS

BACKGROUND OF THE INVENTION

The present invention relates to a method and apparatus for the high speed manufacture of folded reinforced flat bottom bags of the type disclosed in U.S. Pat. No. 3,970,241.

SUMMARY OF THE INVENTION

In U.S. Pat. No. 4,230,030 there is disclosed an apparatus and method for manufacturing the reinforced flat bottom bag. The present invention is an improvement upon such prior disclosed method and apparatus in that it teaches a method and apparatus by which the same bags may be manufactured in a rapid production manner inexpensively and finished in a folded condition with a more precise arrangement of constructural details that enable the manufacture of bags that are stronger than heretofore made and more attractive in appearance.

In the manufacture of the reinforced flat bottom bags, the bottom of the bag is creased and flattened with greater precision and sharpness to produce folds and seals of greater strength than capable of being made heretofore. The present invention is an improvement upon such prior patented disclosures in that it teaches for the first time a method and apparatus that uses a forming assembly that shapes the flat bottom bag over substantially its whole planar extent by cooperating with a folder assembly that clamps the bag bottom between them. The cooperation between the former assembly and the folder assembly produces a reinforcing seal of greater strength and extent and further serves to flatten the bottom of the bag into a stronger and more attractive appearance.

The present invention further teaches the relative movement of the forming assembly and the folder assembly such that in one relative position of movement the flat bottom of the bag is completely formed and sealed, while in another relative position the folder assembly folds the flat bottom of the bag along one of its walls as is illustrated in FIG. 1 of my U.S. Pat. No. 3,970,241. During the folding operation and the relative movements of the forming assembly and the folder assembly, the finished bag is removed from the forming assembly thereby freeing the forming assembly to form a new bag while the bag continues to be folded by the folder assembly and is dispensed by such latter assembly from the apparatus.

The above description, as well as further objects, features and advantages of the present invention, will be more fully appreciated by reference to the following detailed description of a presently preferred, but nonetheless illustrative, embodiment in accordance with the present invention when taken in conjunction with the accompanying drawings wherein:

DESCRIPTION OF THE DRAWINGS

FIGS. 8 to 10 are sequential views of the operating positions of the folder assembly;

FIG. 10A illustrates the details of the bag as folded during the operation of the folder assembly in its position as shown in FIG. 10;

DETAILED DESCRIPTION OF THE PREFERRED EMBODIMENT

Figure 1:
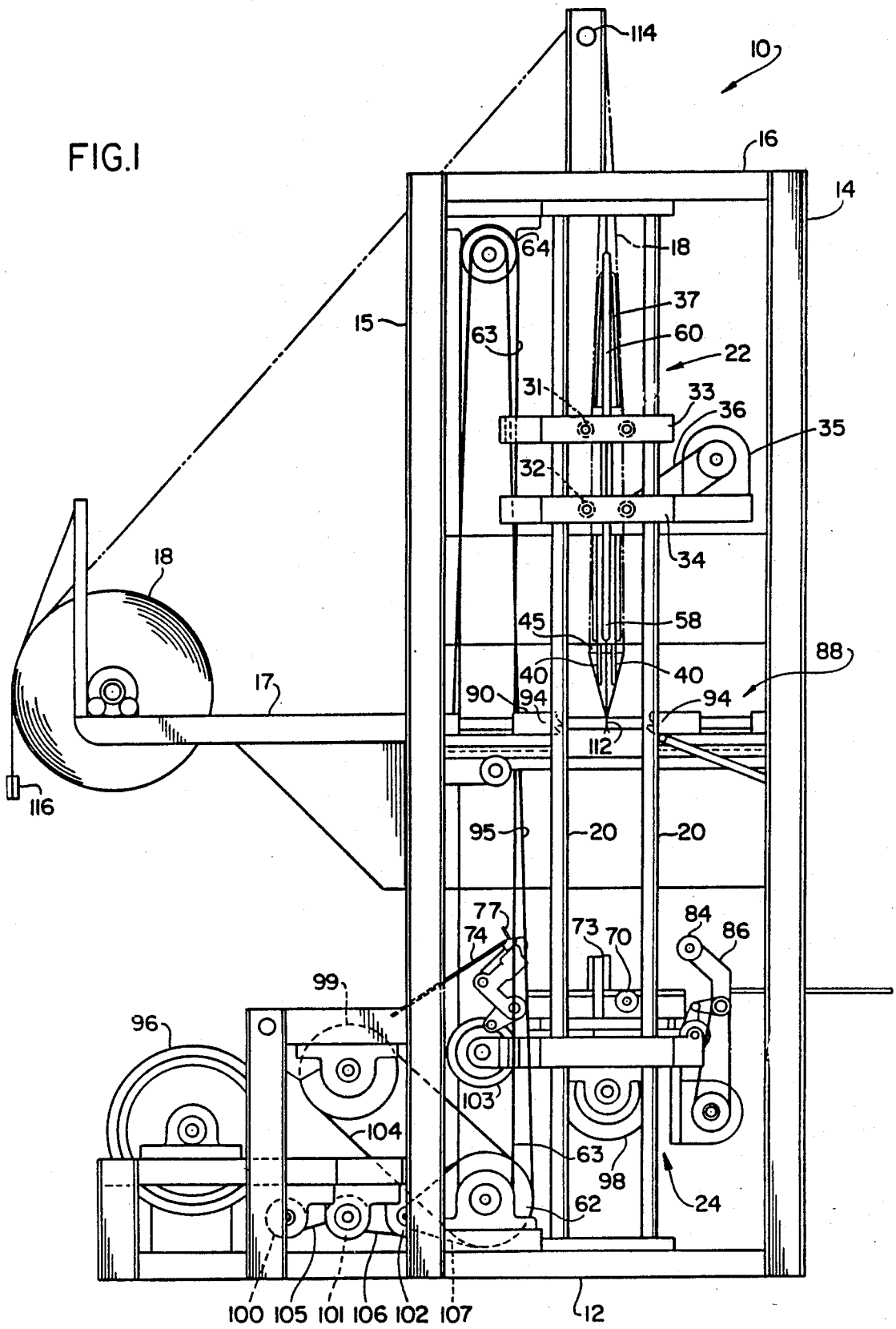
FIG. 1 is a side view of a machine for manufacturing folded flat bottom bags constructed according to the present invention.
Figure 2:
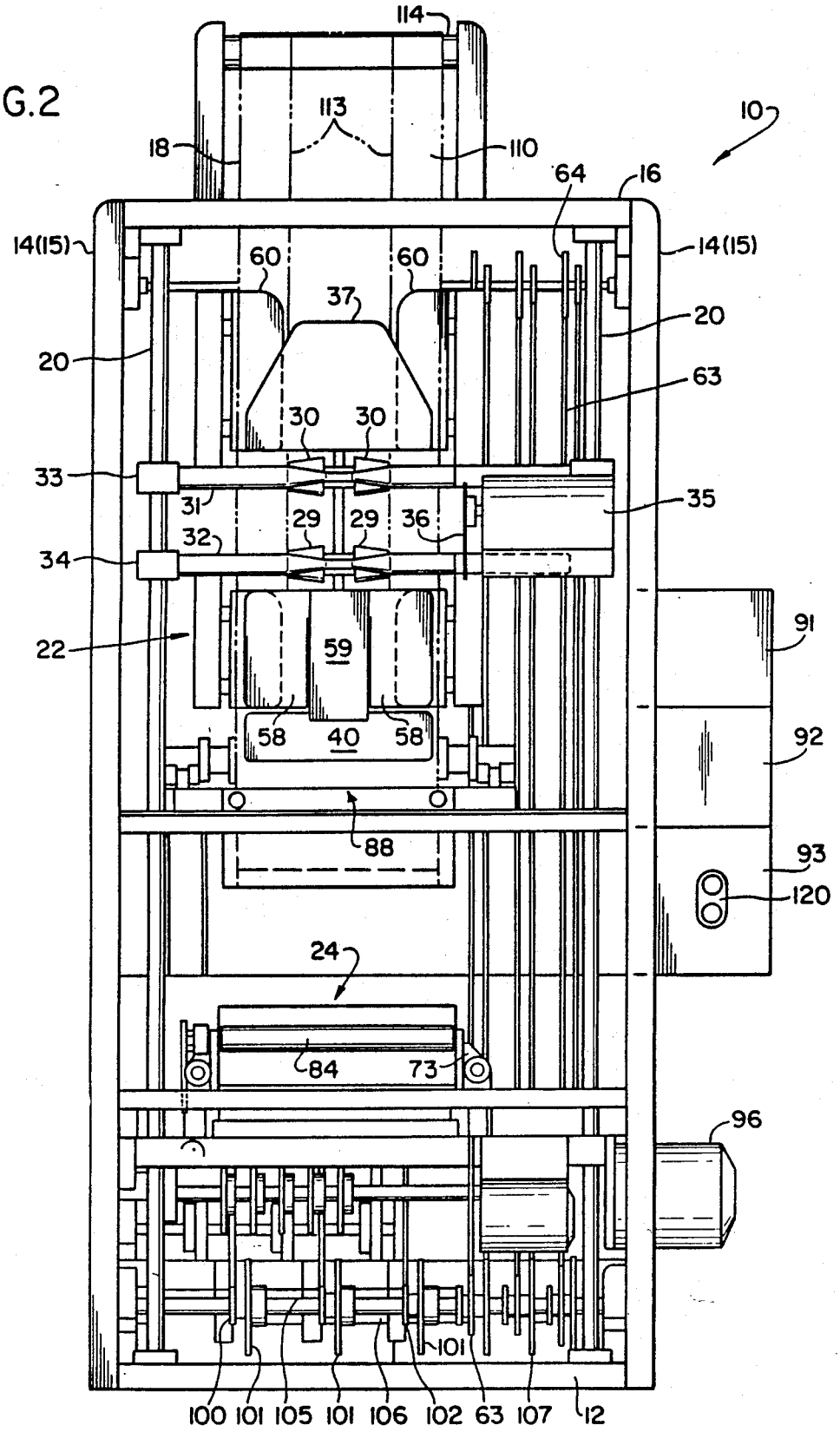
FIG. 2 is a front elevational view of the machine of FIG. 1.
Figure 16:
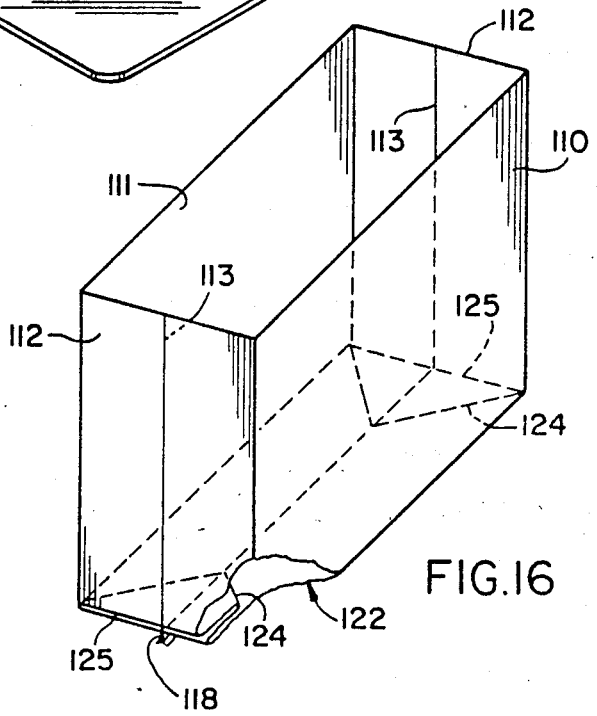

Referring to the drawings and more particularly to FIGS. 1 and 2, the apparatus thereshown is generally identified by the numeral 10. It depicts a machine for making and folding reinforced flat bottom bags of the type substantially as disclosed in U.S. Pat. No. 3,970,241 and as illustrated in FIG. 16. The apparatus or machine 10 for making and folding flat bottom bags requires a relatively small floor area because it is disposed generally vertically, extending upwardly from a base 12. The frame of the apparatus 10 includes a plurality of front corner posts 14 and rear corner posts 15 that are connected at the top of the frame by headers 16.

Mounted to the rear of the frame and forming a part thereof are a pair of beams 17 that are disposed horizontally rearward and relatively spaced to provide a support for a supply roll of heat sealable material 18 from which the flat bottom bags are to be formed. The supply roll of bag forming material 18 is substantially continuous in length and may be supplied in the form of a closed tubular web or tube-shaped sleeve. It is not unusual for manufacturers of such rolls of closed sleeve plastic material to supply the same with flat faces and inwardly gussetted sides much in the nature as that shown in FIG. 14. Hence, it is possible to utilize a supply of material 18 that has a sleeve shape and that may or may not be pregussetted to eliminate the need to form such gussets at a later time in the present bag forming machine 10. The supply roll of bag forming material 18 may be of a heat sealable plastic material.

Although it is not necessary that the sides or faces of the machine or apparatus 10 need be denominated as such, it is convenient for purposes of description that the space between the front post 14 be denominated as the front and that the space between the rear post 15 be referred to as the rear, while the front to rear spaces between the posts 14 and 15 on each side be referred to as the sides. Supported in position between the top 16 and the bottom 12 are four relatively spaced slides or standards 20 on which are mounted an upper bag forming assembly generally identified by the numeral 22 that is more fully illustrated in FIGS. 3 to 7 and a lower bag forming assembly generally identified by the numeral 24 that is more fully illustrated in FIGS. 8, 9 and 10.

Figure 3:
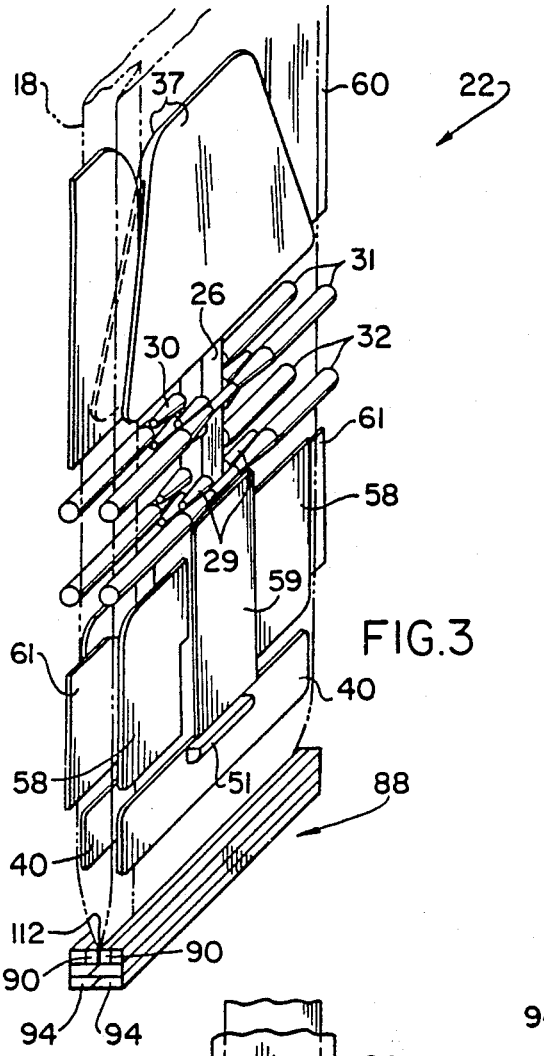
FIGS. 3 to 6 are sequential views of operating positions of the bag forming assembly.
Figure 5:
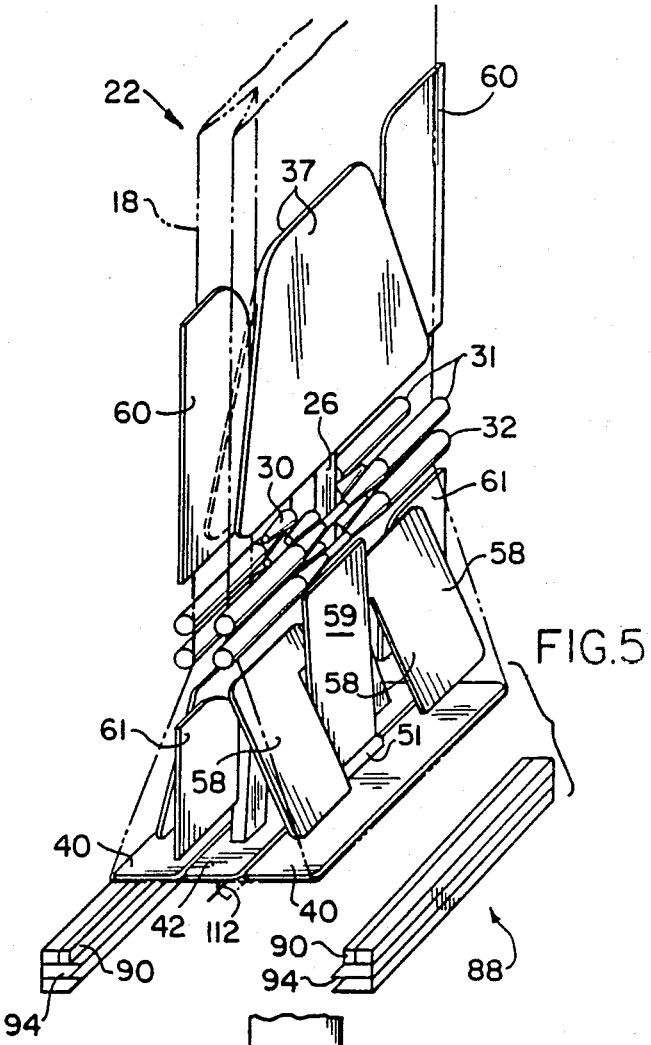
Figure 4:
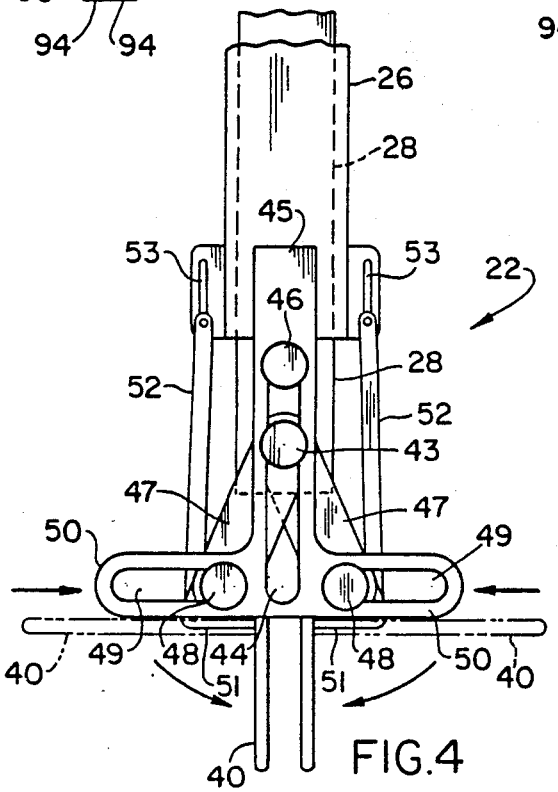
Figures 11, 12, 13:
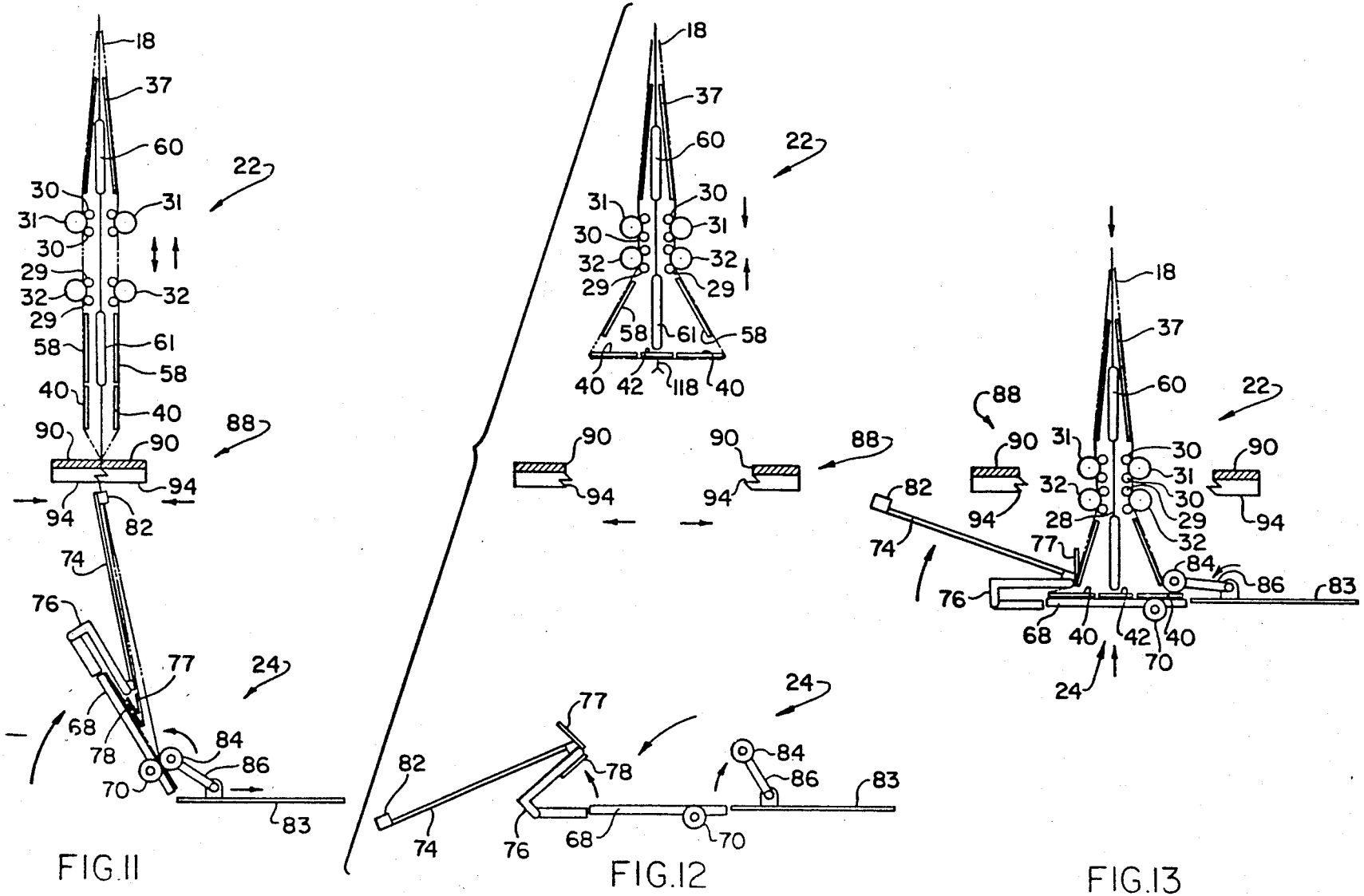
FIGS. 11 to 13 are sequential views of relative operating positions of the bag forming and folder assemblies.

The bag forming assembly 22, as seen more fully in FIGS. 3 and 5, includes a floating mandrel that comprises a hollow sleeve 26 in which an operating arm 28 is caused to move between a raised inoperative position as illustrated in FIGS. 3, 4 and 11 and a lowered operative bag forming position as shown in FIGS. 5, 6, 12 and 13. To operate the arm 28 between its inoperative and operative positions, it supports a plurality of relatively spaced lower idler rollers 29 that project from the sides thereof. Although not illustrated in the drawings, the idler rollers 29 project outwardly from the arm 28 through openings provided therefor in the hollow sleeve 26.

Mounted on the hollow sleeve 26 are a plurality of relatively spaced upper idler rollers 30. Captured between the relatively spaced upper rollers 30 are front and rear upper rollers 31 that are fixed in position with respect to the bag forming assembly 22 while the relatively spaced lower idler rollers 29 capture between them a pair of front and rear lower operating rollers 32.

The upper rollers 31 are rotatively mounted on the frame 33 that slides on the standards 20. The operating rollers 32 are supported for rotation in the frame 34 that is movable lengthwise along the slides 20 and moves toward and away from the frame 33. The cooperating rollers 30 and 31 are tapered as is more clearly illustrated in FIGS. 3 and 5 so as to automatically self-align the rollers and maintain the floating mandrel in a substantially vertical centered position in the apparatus 10.

As the description proceeds, it will become clear that the rollers 31 rotate idly whereas the rollers 32 are rotated by a motor 35 that is supported on the frame 34 and connected with the rollers 32 by a rotating drive belt, gear or other suitable drive connection 36 as can be seen in FIG. 2. By reason of the clamping arrangement that is effected between the idler rollers 29 and 30 with their respective rollers 32 and 31, the bag forming assembly 22 is able to be supported in suspension and reciprocably moved up and down between the slide standards 20 in a manner to be described.

Included in the mandrel of the bag forming assembly 22 is a double sided guide plate 37 that is mounted on the sleeve 26, the faces of which are elongated in the direction of the length of the mandrel and relatively spaced to form a tapered gussetting opening at its opposite sides. A pair of elongated flat wings 40 and a pair of side wings 42 form a part of the mandrel for shaping and forming the flat bottom of the bag to be formed of the material 18. The elongated wings 40 are transversely directed to extend along the full length of the front and rear faces of the bag forming material 18.

Figure 6:
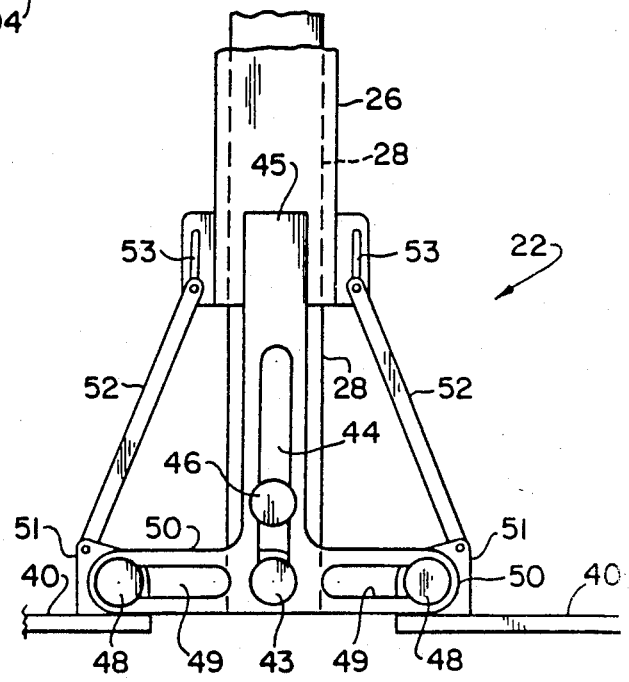
Figure 7:
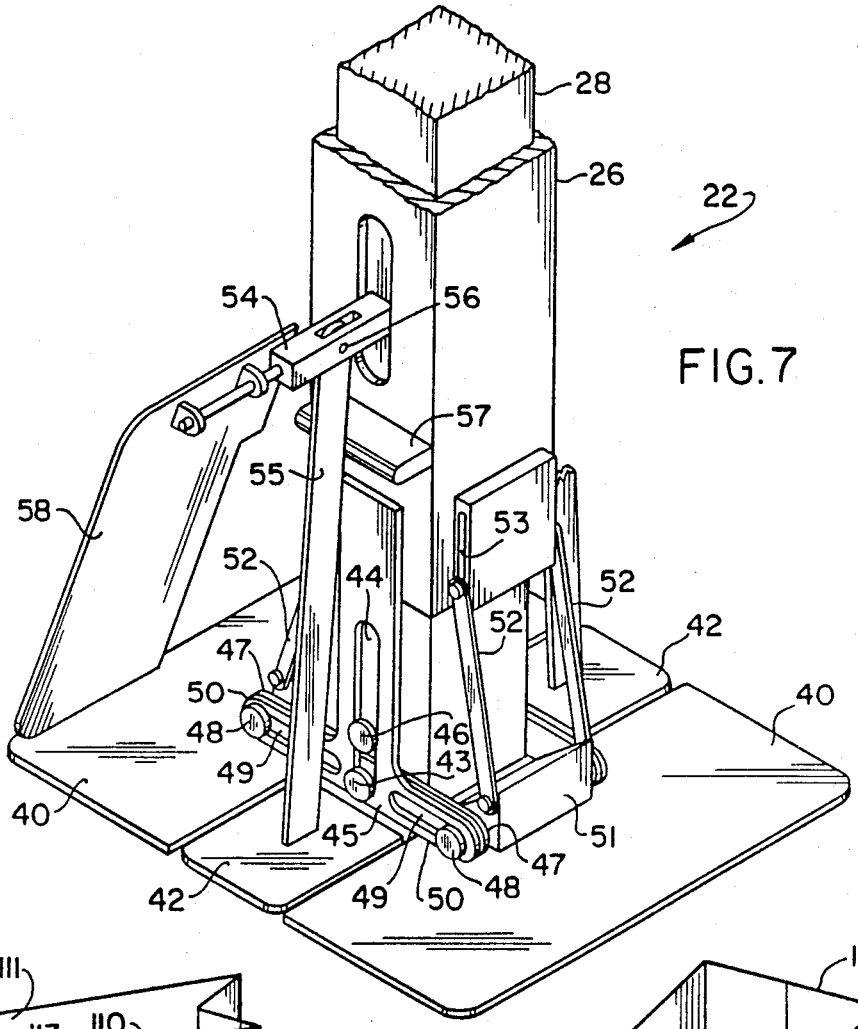
FIG. 7 is a partial perspective view of the interior operating details of the bag forming mandrel.

The wings 40 are actuated in response to the relative reciprocating movement of the arm 28 and the sleeve 26. Thus, when the lower oppositely disposed rollers 32 are operated to reciprocate relative to the upper rollers 31, they cause the arm 28 to reciprocate relative to and within the sleeve 26 by reason of their cooperation with the engaging idlers 29. When the lower frame 34 is reciprocated in a direction downward and away from the upper frame 33, the lower rollers, and consequently the arm 28 move with it to move the mandrel structures to their operative positions, and vice versa. A pair of shoulder screws 43, each mounted on opposite sides of the arm 28 (only one of which is shown in FIGS. 4, 6 and 7), are guided within a cam slot 44 of an inverted T-shaped guide 45. to assure that the operating screw 43 moves smoothly and in a straight line in the cam slot 44, there is provided a second set of guide shoulder screws 46 mounted to the arm 28.

Connected to each operating screw 43 are a pair of oppositely directed links 47 which are pivotally connected at their opposite ends to another shoulder screw 48 that is guided for sliding movement in a cam slot 49 in a laterally directed arm 50. Forming a part of each of the wings 40 is a block 51 that moves to pivotally mount the links 52 with a guide slot 53 that is conveniently provided on the front and rear sides of the sleeve 26 to guide the movements of each respective wing 40 between its inactive position as shown in FIGS. 3, 4, 6 and 11 and its flat operative extended position as shown in FIGS. 5, 7, 12 and 13.

The two side wings 42 are intended to fill the space between the operative wings 40 when the same are in their opened operative extended positions. The two side wings 42 are operated between their bag forming active positions as shown in FIGS. 5 and 7 and their inactive hidden positions in which they drop down between the inactive downwardly extending wings 40 as shown in FIGS. 3, 4 and 11. Extending from each of the sides of the arm 28 is a support bar 54 that has an elongated slot in which a smaller lever 55 is pivotaly mounted by a pin 56. The other end of each lever 55 is fixed to a respective side wing 42 and is movable with the arm 28 along a projecting cam 57 that is provided on the sleeve 26.

When the operating arm 28 moves downward relative to the sleeve 26, the lever 55 is actuated outward by the cam 57 to its extended active position as shown in FIGS. 5, 7, 12 and 13. When in its extended active position, each wing 42 is positioned in flat horizontal alignment with the adjacent wings 40 to form a smooth substantially flat continuation of such wings 40 with little space or interruption between the same. When the arm 28 moves upward relative to the sleeve 26, it lifts the bar 54 a greater distance away from the cam 57. This permits the lever 55 to drop inward and downward from its active to its inactive position between the inactive wings 40 which similarly drops downward as is shown in FIGS. 1, 3, 4 and 11.

In an effort to provide the front and rear of the mandrel with relatively smooth and uninterrupted faces along which the bag forming material 18 can slide without obstruction, covering face plates 58 are provided along the sides of each face and a covering plate 59 is positioned therebetween. The elongated plates 58 are freely pivotted at their upper ends on the bars 54 as is partially illustrated in FIG. 7. They slide along the wings 40 at their lower ends to tilt angularly outward with the wings 40 when the same are raised to their active extended operating positions. They drop downward to their inactive position as shown in FIG. 3 when the wings 40 are moved to their inactive positions.

Figure 14:
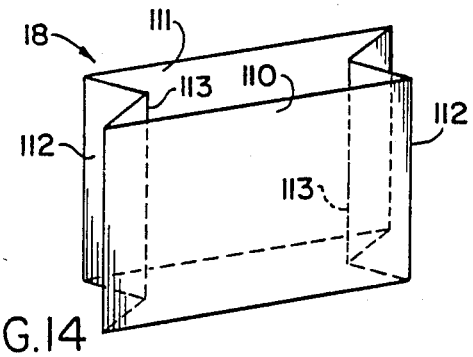
FIGS. 14 to 16 are sequential views showing the stages in the manufacture and formation of a flat bottom bag.

External to the mandrel of the bag forming assembly 22 and forming a part thereof are upper and lower blades 60 and 61 which will gusset the sides of the material 18 when the material is slid down along the mandrel or will maintain such gussets when the material is pregussetted as in FIG. 14. The bag forming assembly 22 is moved reciprocably as a unit in the framework of the apparatus 10 by an operating mechanism which includes the operating sprocket 62 connected with a chain 63 that moves over an idler sprocket 64. The member 62 may be a cam and 63 may be a cam follower. Hereinafter wherever reference is made to a sprocket and chain or a cam, it is intended to mean that there is a cam follower cooperating with the cam and used with the same for the same purposes as the sprocket and chain inasmuch as the sprocket and chain and cam and cam follower are deemed to be mechanical equivalents. The chain 63 is connected with the lower frame 34 of the assembly 22 to reciprocably move the same to raise and lower the frame within the apparatus 10. The chain extends for free movement through the frame 33 so as to permit the two frames 33 and 34 to move relative to each other.

The bag folding assembly 24 is positioned within the apparatus 10 below the bag forming assembly 22. As can be seen more clearly in FIGS. 1, 2, 8, 8, 9 and 10, the folding assembly 24 is slidably mounted for reciprocating movement along the slide standards 20 at a frame 66. The frame 66 supports a relatively flat planar member 68 that is movable between a substantially horizontal position as shown in FIGS. 8 and 9 and a tilted position as shown in FIG. 10 during which the folded bag is to be removed from the apparatus 10. Located intermediate the lateral ends of the planar member 68 and extending for the full lengthwise extent thereof is a feed roller 70.

In practice, the lateral extent of the member 68 is at least as great or as wide as or greater than the sides of the bag that is to be formed by the forming assembly 22. Hence, the width of the member 68 is at least as wide across as the combined width of the wings 40 and 42 when the same are in their active positions as shown in FIGS. 5, 6 and 7. The length or transverse extent of the member 68 is also at least equal to and greater than the extent of the front and rear faces of the bag and of the wings 40 of the forming assembly 22. Provided along each of the opposite sides or widths of the planar member 68 is a sealing means in the form of an electrically operated heater band 72 for producing side seals in the bag.

Hinged to and forming a part of the folder assembly 24 are oppositely disposed gusset flap retainer plates 73 that are movable between an inoperative position as shown in FIG. 8 wherein they are removed out of covering relation with the member 68 and an operative position in which they press downward toward the member 68 to crease and form gusset flaps in the bag in a manner to be described. The gusset flap retainer plates 73 are actuated in unison in a predetermined and controlled sequence with the related structures of the assembly 22 and 24 by the drive mechanisms that will be described.

It will also be noted that the gusset flap retainer plates 73 are not only operated between inactive upward positions in which the same are substantially out of the path and free of obstruction with the planar member 68 as is shown in FIG. 8. But they also move to an active position as shown in FIG. 9 in which they serve to tuck and flatten the gussetted side walls to form the flaps of the bag flat against the bottom of the bag when the bottom is positioned on the planar member 68 in a manner to be described. The gusset flap retainer plates 73 are operated at a hinge mechanism therebelow as shown by the pivot 75 to enable each gusset plate to lie substantially flat in planar relationship with the planar member 68 during the folding of the bag as is illustrated in FIG. 10 and in the manner to be described.

Included in the folder assembly 24 is a folder member 74 that is hingedly mounted on the assembly by a pair of hinge arms 76 as seen more clearly in FIG. 8. The folder member 74 is normally positioned out of covering relation with the plate or planar member 68 so as to leave the same open and unobstructed for cooperation with the mandrel wings 40 and 42 of the bag forming assembly 22. The folder member 74 is conveniently shown with two relatively movable walls 77 and 78 that are joined at a right angle that defines a pointed crease forming edge 79 which functions to produce a crease in the bag that is formed by the assembly 22.

Joined with the walls 77 and 78 and pivotted with respect to the same is a stabilizer support 80 in the form of a four sided frame. The support 80 is provided with transversely spaced clamps 82 that are normally open but actuate closed to clamp and grip the widths of a bag that come into contact with the same as is shown in FIG. 10. The clamps 82 may be spring actuated to release and open to their inoperative position when the weight of the walls of the bag thereagainst is removed.

Positioned along and in line with the opposite face or edge of the planar member 68 is a fixed take-off member 83 over and along the surface of which the completed bag is fed to facilitate the removal of the bag from the assembly 24 and the apparatus 10. The completed bag is removed from the assembly 24 by a feed mechanism which includes the feed roller 70 and a cooperating roller 84 that is rotatably mounted and driven at its opposite ends on movable arms 86 pivotted to the assembly 24. The movements of the support 80 and the arms 86 that move the take-off roller 84 into and out of cooperation with the feed roller 70 are coordinated and selectively controlled by respective ones of individually operated cams and chain drives.

Provided on the apparatus 10 and interposed between the bag forming assembly 22 and the folding assembly 24 is a bag sealing and severing assembly generally identified by the numeral 88. The assembly 88 comprises two facing elongated sealing members 90 that extend for at least the transverse length of the bag to be sealed. When the bag forming material 18 is a heat sealable plastic, the sealing members are heated by electricity from a source supplied from electrical boxes 91 and 92 respectively which are controlled by components in a housing 93 that may be conveniently mounted close by on the apparatus frame.

Severing or bag material shearing knife blades 94 that form a part of the assembly 88 are conveniently positioned below the heat sealing members 90 so that both of them may be actuated substantially simultaneously, although not necessarily, by a part of the motor drive control mechanism located at the bottom of the apparatus 10 for coordinating operation of the bag forming assembly 22 above it and the folding assembly 24 below it. The facing blades 94 move into and out of cooperation with each other when the assembly 88 is actuated in response to the controlled movement of the chain 95.

FIGS. 1, 5, 12 and 13 show the parts 90 and 94 of the assembly 88 in their inoperative position. When the chain 95 is operated in its controlled sequence by its respective cam 62, the assembly 88 is moved closed into its operative position as is shown in FIGS. 3 and 11 during which the sealing members 90 seal the bottom of the bag fully along its transverse extent while the blades 94 cut the bag forming material 18 below the transverse seal. This severs the formed bag immediately therebelow from the bag forming material 18 that is being formed into a bag immediately thereabove by the bag forming assembly 22.

The main drive motor 96 initiates and continues the operations of the assemblies 22, 24 and 88 of the apparatus 10 in a selected controlled manner. In this regard, the upper bag forming assembly 22 is controlled by the sprocket or cam 62 while the lower bag folding assembly 24 is controlled in its operation by the cam 98. Additional control sprockets or cams 99, 100, 101, 102 and 103 are connected with each other in timed control and sequence of operations by respective linking chains 104 to 107. Although the sequentially controlled operation of the parts of the assemblies of the apparatus 10 have been accomplished, in actual practice, by the use of cams and linking chains, it is to be understood that other forms of drive controls, such as pneumatic, hydraulic or other electromechanical mechanisms, or combinations thereof may be utilized without departing from the scope of the invention.

In operation the supply of bag forming material 18 of heat sealable plastic in large continuous rolls is mounted on the machine. The rolled material 18 can be in sheet form. However, it has been found in practice that when the roll of material is made in the form of a closed elongated sleeve that is gussetted at its opposite sides such as is shown in FIG. 14, the apparatus 10 is able to manufacture and fold the material 18 into flat bottom bags more rapidly and more precisely than if the material is provided without gussets.

The roll of material 18 provided in the gussetted form of FIG. 14 has a front face 110 and a rear face 111 and opposite sides 112 that are gussetted to form crease lines 113. The roll of material 18 is fed up and above the bag forming assembly 22 and then fed downwardly over a support roller 114 that is raised above the top of the headers 16 in line with the assembly 22. To keep the roll of material from unwinding too freely, a drag weight 116 embraces or wraps about a portion of the outer surface of the roll 18 to function as a drag brake thereon.

The gussetted sleeve of material 18 is fed downwardly over the top of the mandrel guide plate 37, inside the gusset retention blades 60 and down between the inner mandrel roller sets 30 and 29 and their respective outer engaging rollers 31 and 32. Thus, the length of material 18 is positioned between the outer rollers 31 and 32 and their respective sets of capturing rollers 30 and 29. The gussetted sides 112 of the bag material are threaded between the plates 37 and gusset forming plates 60 whose inner lengthwise edges engage with the crease lines 113 to guide the downward feeding movement of the material 18 over the floating mandrel to retain the sharpness and definition of the gussets. The material 18 is also fed between the lower gusset retention blades 61 and the face plates 58.

With the mandrel in its inactive position or mode, the sleeve or bag forming material 18 is threaded downwardly further over the plates 58 and 59 which provide relatively smooth and unobstructed surfaces. The material 18 is fed or initially pulled downwardly manually to its starting position to cover fully the downwardly directed wings 40 as is shown in FIG. 3. To do this, the material is positioned below the bottoms of the wings 40 and beyond the operating level of the sealing and severing assembly 88, as is shown more clearly in FIGS. 1, 2 and 3. At this point, it should be noted that before the start of the apparatus 10 the sleeve of material 18 extends downward beyond the assembly 88 to assure that there is sufficient material extending therebelow so as to enable the assembly to form the first transverse seal or seam 118 across the full front and rear faces 110 and 111 of the gussetted material 18.

With the bag forming material 18 in its initial starting position below the bag sealing assembly 88, the apparatus 10 is then able to operate automatically thereafter. This is accomplished by actuating the electrical system by engaging a master switch 120 on the housing 93. Closure of the switch 120 initiates the electrical circuits by connecting them with the source of electricity for the heating elements 72 and 90 for controlled sequences of operation. It also initiates the operation of the main drive motor 96 that selectively controls, in turn, the coordinated sequence of operations of the assemblies 22, 24 and 88 by way of the interconnect cams 99 to 103 and the driven chains 104 to 107 connected with the same.

Figure 15:
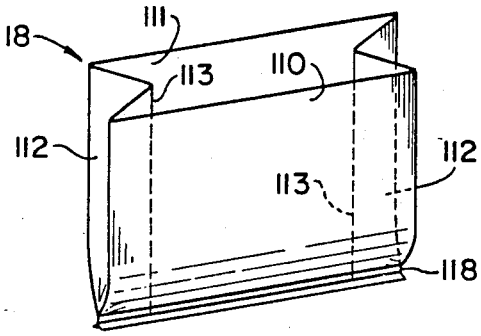

The controlled sequence of operation begins with the closing of the bag sealing and severing assembly 88 during which the heat sealing members 90 close against the adjacent faces 110 and 111 of the bag forming material 18 to compress them together and seal them together as can be seen in FIGS. 3 and 11. The seal 118 formed by the members 90 along the transverse extent of the material 118 fully seals the faces 110 and 111 to each other. Included in the transverse seal 118 are the walls of the two sides 112 with their crease lines 113 located inward from the respective sides as shown in FIG. 15.

At substantially the same time, the blades 94 also come into severing cooperation with each other to cut and separate from the bag to be formed by the bag forming assembly 22 immediately above whatever material there is below the assembly 88. The material 18 is severed by the blades 94 at a length sufficiently below the seam 118 so as to leave the integrity of the seam intact and not to weaken the same. As the description proceeds, it will become clear that the severing operation also serves to cut free a previously formed bag that has been transferred to the lower folding assembly 24 from the new bag to be formed by the upper bag forming assembly 22.

Immediately after the formation of the transverse seam 18, the upper bag forming assembly 22 is actuated from its inactive position wherein its wings 40 and 42 are out of bag forming position as in FIGS. 3 and 4 to their extended bag forming positions as in FIGS. 5 and 6. This results from the lowering movement of the lower frame 34 connected with and for movement by the chain 63 passing freely through the upper frame 33 causing the mandrel arm 28 to lower within and to move relative to the sleeve 26. The movement of the upper frame 33 relative to the lower frame 34 is effected by the chain 107, although such relative movement also may be accomplished in the manner taught by applicant's prior U.S. Pat. No. 4,230,030. This relative movement of the mandrel parts activates the mechanisms for extension of the wings 40 and 42 to expand and flatten the sealed bag material 18 to form the flat bottom of a bag as is shown at 122 in FIG. 16.

During the flattening and outward extension of the bag sides by the wings 40 and 42 as is shown in FIGS. 5 and 6, the creases 113 of the gussetted sides 112 are also flattened to produce gussetted flaps 124 as shown in FIG. 16. Each of the flaps 124 has a crease 125. While the mandrel wings are being moved to their operated bag forming positions, the motor 35 rotates the material drive rollers 32 by way of the drive chain 36 to feed the material in a downward direction that moves and supplies additional material from the roll toward the wings 40 and 42 to aid in enabling the wings to open within the interior of the bag to extend open the side walls of the bag and flatten the material 18 by the mandrel. During the flattening of the bottom of the bag 122, the severing and sealing assembly 88 is opened and the sealing and severing elements 90 and 94 are withdrawn from their operative positions as shown in FIGS. 3 and 11 to their inoperative positions as shown in FIGS. 5, 12 and 13 out of the path of the assembly 22.

While the mandrel is in the process of opening the walls of the bag material 18 and forming the flattened bottom of the bag, the whole upper bag forming assembly 22 is lowered and the whole bag folder assembly 24 is raised by the chain 95 so that both assemblies move relatively toward each other. During such relative movements toward each other, the mandrel wings of the forming assembly 22 continue to move progressively toward their fullest extended positions, as shown in FIGS. 5, 6, 7 and 12. At the same time as the folder assembly 24 is being moved upward as a unit, its operating parts are moved to their open positions as is illustrated in FIGS. 8 and 12.

When the two assemblies 22 and 24 are moved into cooperating engagement with each other with the flat bottom of the bag 122 positioned therebetween as is shown in FIG. 13, the wings 40 and 42 press the outer bottom surface of the bag against the flat plate member 68 of the lower folding assembly 24 to fully flatten the bottom of the bag there against. During such flattening movement, the heater bands 72 at the opposite ends of the member 68 are operated to heat seal the gusset flaps 124 in a lateral direction to the transversely sealed bag bottom to form a flat reinforcement thereat when both assemblies are momentarily in contact with each other as is illustrated in FIG. 13. The creases 125 are thereby heat sealed along their lengths to the flat bottom of the bag and to the transverse seal 118.

Thereafter, both assemblies 22 and 24 are moved away from each other, each as a unit and with each such unit continuing progressively through its respective operations. However, during such momentary contact the idler feed roller 84 is moved by the arms 86 into pressure engagement with the outer surface of the front wall 110 of the bag, pressing the bag against the wing 40 sandwiched between it and the plate member 68. The other wing 40 is sandwiched between the folder walls 78 and the flat plate 68. These sandwiched engagements press the bag walls 110 and 111 flat against the plate 68 with the elongated corner edge of the walls 77 and 78 creasing the wall 111 of the bag along its transverse extent to produce a fold line 126 above the bag bottom.

Although the wings 40 are momentarily sandwiched in location within the interior of the bag, when the assemblies 22 and 24 begin their relative separating movements, the wings tilt upward and slip free from between the overlying and underlying parts of the assembly 24. That is to say, the wings 40 tilt upwardly during the relative movement of the arm 28 within its sleeve 26 of the mandrel when the mandrel begins its progressive return to its initial starting position such as is illustrated in FIGS. 3, 4 and 11.

As the bag forming assembly 22 rises, the arm 28 rises within the sleeve 28 causing the wings to collapse and slide free of the assembly 24 from between those portions of the walls that are engaged between the roller 84 and the plate 68 and the walls 78 and the plate 68. Continued upward movement of the assembly 22 causes the arm 28 of the mandrel to move upwardly with it to activate the wings into their fully withdrawn inoperative positions as is shown again in FIGS. 1, 3, 4 and 11.

While this movement of the upper assembly 22 and its mandrel is occurring, the bag 122 remains held in and by the lower assembly 24 between the roller 84 and the walls 78 and the plate 68. Thus, as the lower and upper assemblies move away from each other, the bag 122 is held in the lower assembly 24 and moves downwardly with the downward movement of the lower assembly. This causes the remainder of the material 18, still connected with the bag 122, to be pulled downward with the assembly 24 from the roll 18, thereby providing a new supply of material 18 about the assembly 22 as the assembly 22 moves upwardly therein and returns to its initial starting collapsed position as is seen in FIG. 11 where it is ready to be opened once again to its bag forming position as is shown in FIG. 12 for a new bag forming operation.

During the progressive lowering of the assembly 24 to its position as shown in FIG. 11, the bag 122 is folded along its crease line 126. The gusset retention plates 73 on the lower assembly 24 press the side walls 112 of the bag inwardly while the folder member 74 rises pivotally against the wall 111. When the clamps 82 come into contact with the wall 111, they clamp and hold the front and rear walls 111 and 110 together as is shown in FIG. 10. At that time, the folder walls 77 and 78 are located between the bag wall 111 and the flat plate 68 against which the bag remains pressed flat to fold the bag bottom as the plate 68 pivots in an angular upward tilted direction as is shown in FIG. 10. The feed roller 70, engaging the bag bottom, becomes aligned with idler roller 84 to roll the bag 122 of the tilted plate 68 and onto the take-off member 83 where it is guided to a stack of previously formed and folded bags.

When once the bag is removed from the plate 68, the plate and folder member 74 move back to their initial starting positions as is shown in FIGS. 8 and 12. The clamps 82 reopen for a new operation after the bag 122 is fed outward therefrom by the roller 70. However, before the folded bag 122 can be removed from the folding assembly 24, it is first necessary to sever the same from the remainder of its bag forming material 18 immediately thereabove. This is done after the forming assembly 22 has returned fully to its starting position as is shown in FIGS. 1 and 11.

As soon as the assembly 22 has reached the limits of its upward movement, the bag sealing and severing assembly 88 is actuated to its operative position as is shown in FIGS. 3 and 11. Since its operation is momentary, it forms the transverse seal 118 and severs the already formed bag 122 held in the assembly 24 therebelow from the material 18 thereabove, thereby permitting the formed bag 122 to be removed from the assembly 24.

When once the seal 118 is made beneath the assembly 22, the material 18 is closed about the mandrel. Hence, as the upper assembly 22 moves progressively along its downward path once again, the material 18 is pulled with it downward toward the lower assembly 24 that rises to meet the bag forming material 18. The downward movement of the material 18 with the assembly 22 is aided by the feeding movement of the motor 35 that rotates the rollers 32 that engage the front and rear faces 110 and 111, respectively, to feed additional material 18 that is required to aid in spreading the walls 110, 111 and 112 relative to each by the mandrel wings 40 and 42. An automatic repetition of the aforedescribed sequence of bag making operations is then performed.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a machine for making and folding open top flat bottom bags from a heat sealable material comprising, bag forming means on said machine for forming in the material, opposed faces and opposed sides and a flat bottom for a bag including said opposed faces and sides, means on said machine supplying a continuous length of heat sealable material to said bag forming means, closure sealing means on said machine for forming a closure seal on said material, material severing means on said machine for severing a length of said material to form the open top of the flat bottom bag, folding means on said machine having bag bottom sealing means for sealing opposed portions of the opposite sides to the flat bottom, and said folding means and forming means being adjacent for engaging therebetween the opposed sides and bottom of the bag while said bottom sealing means seals portions of the opposed sides to the flat bottom of the bag, and said folding means having means for removing the severed length of material from said bag forming means while folding the flat bottom of the bag alongside an extent of the severed length of the material.

2. In a machine as in claim 1, said bag forming means and folding means engaging means releasably engaging the sides and faces of the bag to flatten the same therebetween and for sealing the portions of the sides of the bag to the flat bottom of the bag.

3. In a machine as in claim 1, and means on said folding means to gusset the opposed sides of the heat sealable material.

4. In a machine as in claim 3, said bag forming means and folding means including means cooperating to flatten between them the gussets of the opposed sides to form gusset flaps and to seal the gusset flaps to the flat bottom of the bag.

5. In a machine as in claim 1, said folding means and forming means being movable on said machine toward each other to flatten and seal the opposed sides to the flat bottom of the bag and being movable on said machine away from each other, said folding means including means for engaging the flat bottom of the bag to remove the severed length of the material from said bag forming means during the movement of said folding and forming means away from each other.

6. In a machine as in claim 1, the continuous length of the heat sealable material being a sleeve enclosing said bag forming means, said closure sealing means being operable to form the closure seal on the material to enclose said bag forming means therein, and said bag forming means forming the flat bottom of the bag with the closure seal included as a part thereof.

7. In a machine as in claim 6, said bag forming means including means to gusset the opposed sides of the sleeve of material, said folding means including means to fold said gussetted sides to form gusset flaps against the flat bottom of the bag, and said folding and bag forming means including said engaging means for simultaneously engaging and sealing the gussetted flaps to the flat bottom of the bag.

8. In a machine as in claim 7, and means on said folding means to remove the severed length of the sleeve material from the bag forming means.

9. In a machine as in claim 8, said sleeve material removing means including cooperating rollers engaging the flat bottom of the bag therebetween.

10. In a machine as in claim 8, said folding means including means to crease one of the opposed faces of the sleeve material and to fold the flat bottom of the bag along the crease and against the one opposed face of the sleeve material.

11. In a machine for making flat bottom bags from a substantially endless sleeve of sealable material having opposed faces and opposed gussetted sides, seal means on said machine for forming a transverse seal to seal together the opposed faces and for including the gussetted sides in said transverse seal, a forming assembly on said machine including means to operate in the interior of the transversely sealed sleeve operating from an inactive to an active position for opening the gussetted sides and having opposed faces forming a flat bottom for a bag in which the gussetted sides form interior flaps to be sealed to the flat bottom of the bag, means on said forming assembly to operate exterior of the sleeve for operating said interior means between its inactive and active positions, a folding assembly on said machine movable toward said forming assembly for engaging the bag therebetween and having bottom seal means cooperating with said interior means for sealing the gusset flaps to the flat bottom of the bag, said folding assembly having folding means for folding the flat bottom of the bag against one of the faces of the bag and having feeding means for feeding the folded flat bottom bag out of the machine, and means on said machine for severing the flat bottom bag across the length of the sleeve of the bag.

12. In a machine as in claim 11, said folding means and forming means cooperable to engage and flatten the bottom of the bag between them before folding the bag and before said interior means is operated to its inactive position.

13. In a machine as in claim 12, said folding means including means for creasing one face of the bag along which the flat bottom of the bag is folded.

14. In a machine as in claim 11, said folding assembly having a planar member cooperable with said interior means to clamp flat the flat bottom of the bag, said gussetted flap sealing means being on said planar member for cooperation with said interior means.

15. In a machine as in claim 14, said folding means and feeding means clamping said interior means between said planar member while flattening the bag bottom and sealing the gussetted flap, and said interior means being removable from its clamped position to its inactive position as said folding assembly moves away from said forming assembly.

16. A method of forming a flat bottom bag of a sealable material comprising moving a continuous sleeve of the bag material and a bag forming assembly relative to each other with the bag material about the bag forming assembly, sealing the sleeve thereby enclosing the bag forming assembly therein, opening the sleeve by operating the bag forming assembly thereby forming bag walls and engaging the sleeve between the bag forming assembly and a bag folder thereby forming a flat bottom for the bag including the seal, folding the flat bottom of the bag by operating the bag folder, separating the folded flat bottom bag from the remainder of the sleeve by cutting the sleeve, and removing the cut flat bottom bag from the bag forming assembly while folding the bag.

17. The method as in claim 16, moving the bag forming assembly and the enclosing sealed sleeve together toward the bag folder while moving the bag folder toward the bag forming assembly and sleeve, and sealing between the bag folder and bag forming assembly certain of the bag walls to the flat bottom of the bag.

18. The method as in claim 17, engaging the flat bottom bag by the bag folder and removing the cut flat bottom bag from the bag forming assembly by moving the bag folder and the bag former assembly away from each other.

19. The method as in claim 18, folding the flat bottom of the bag against one of its walls.

20. The method as in claim 16, moving the continuous sleeve of bag forming material and the forming assembly relative to each other to position the sleeve about the bag forming assembly preparatory for forming another bag.

21. The method as in claim 20, sealing the sleeve to enclose the bag forming assembly therein for forming another bag.

22. The method as in claim 16, sealing the sleeve to enclose the bag forming assembly and cutting the sleeve to separate the folded flat bottom bag from the sleeve at substantially the same time.

* * * * *